United States Patent [19]

Fang

[11] Patent Number: 4,662,854

[45] Date of Patent: May 5, 1987

[54] SELF-PROPELLABLE TOY AND ARRANGEMENT FOR AND METHOD OF CONTROLLING THE MOVEMENT THEREOF

[75] Inventor: Alan Fang, Taipei, Taiwan

[73] Assignee: Union Electric Corp., Taiwan

[21] Appl. No.: 754,821

[22] Filed: Jul. 12, 1985

[51] Int. Cl.[4] ..... A63H 30/00

[52] U.S. Cl. ..... 446/175; 446/460

[58] Field of Search ..... 446/175, 460, 437, 438, 446/462, 457; 180/169, 6.5

[56] References Cited

U.S. PATENT DOCUMENTS

| | | | |
|---|---|---|---|
| 3,011,580 | 12/1961 | Reid | 180/169 |
| 3,130,803 | 4/1964 | Wiggins | 446/175 X |
| 4,245,430 | 1/1981 | Hoyt | 446/175 |

*Primary Examiner*—Mickey Yu

*Attorney, Agent, or Firm*—Kirschstein, Kirschstein, Ottinger & Israel

[57] ABSTRACT

The movements of a self-propellable toy are controlled by an on-board infrared light transmitter and receiver and a control subcircuit operative for detecting obstacles in the forward path of advancement of the toy, and for causing the toy to either advance forwardly toward the detected obstacle or to turn away from the same, in dependence upon a selected control mode.

15 Claims, 6 Drawing Figures

FIG. 1
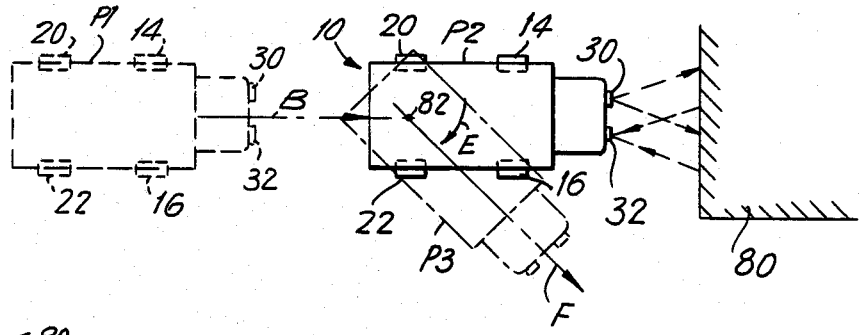
FIG. 2
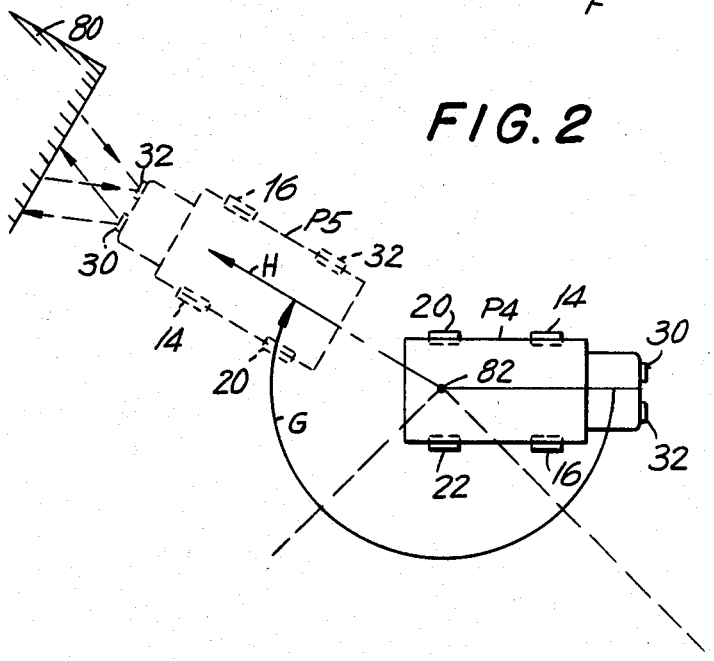
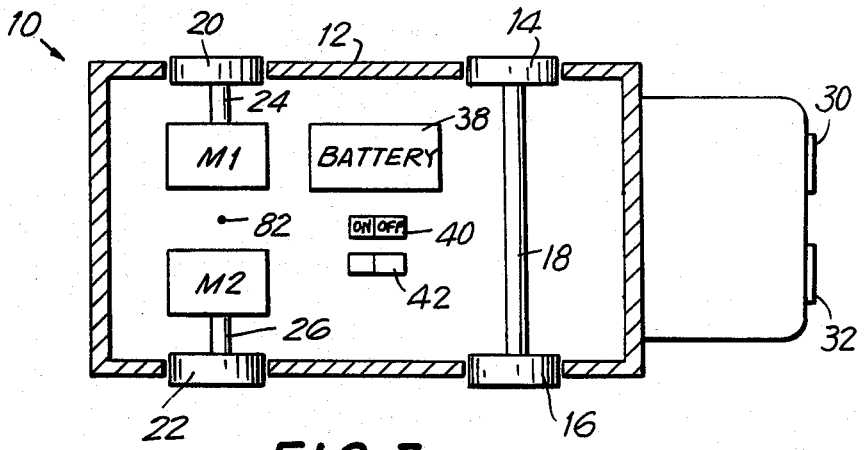
FIG. 3

SELF-PROPELLABLE TOY AND ARRANGEMENT FOR AND METHOD OF CONTROLLING THE MOVEMENT THEREOF

BACKGROUND OF THE INVENTION

1. Field of the Invention

This invention generally relates to the field of self-propellable, motor-driven, mobile toys and, more particularly, to an on-board control arrangement for and method of controlling the movement of such toys toward and away from obstacles in the advancement path of the toy.

2. Description of the Prior Art

It has been proposed in the art of mobile toys to use an external remote-control unit to transmit radio signals, either through the air or by wire, to the toy to control the various movements thereof over a travel surface to be traversed, e.g. a floor, the ground, a table-top, etc. A user manipulating the remote-control unit can cause the toy to go forward, back up, steer right, steer left, stop, etc. Instead of transmitting radio signals, the art has also proposed controlling the movement of a mobile toy by utilizing an external light source, e.g. a flashlight or similar device, see, for example, U.S. Pat. Nos. 2,921,408; 2,922,929; 3,406,481 and 4,086,724; or an external sound source transmitted, e.g. by an audio speaker, see, for example, U.S. Pat. No. 2,892,290.

In addition, the art also has proposed mobile toys whose movements over the travel surface are controlled without the manipulation of exterior remote-control units. Thus, so-called "tracking" vehicle toys are provided with on-board light transmitters, e.g. a light bulb, and on-board light receivers, e.g. a photosensor, both of which face downwardly toward the travel surface on which a predetermined fixed path or track defined by light and dark areas is provided. Thus, as disclosed in U.S. Pat. Nos. 3,130,803 and 2,074,251, the light transmitter emits a light beam toward the track, and the photosensor detects the variable intensity of light reflected from the light and dark track areas. This information is processed to steer the vehicle along the fixed track.

Still another proposal in the prior art of mobile toys relates to so-called "bump and go" toys of the type having a steering plate pivotably mounted on the underside of the toy. A steering wheel is mounted on the plate. In use, when the bump and go toy advances forwardly and collides with an obstacle in its path, the steering plate is turned somewhat, depending, at least in part, on the force of the collision and the speed of the toy, thereby causing the steering wheel carried by the steering plate to be displaced and oriented in a different direction. Hence, the initially forwardly advancing bump and go toy will now proceed in a different direction due to the different orientation of the steering wheel.

Although generally satisfactory for their intended purposes, the various mobile toys of the prior art possess certain drawbacks. For example, the bump and go toys, due to their constant bumping into obstacles, are prone to become damaged and, in time, to become disabled. The tracking toys are limited in their entertainment value because they can only follow a fixed track and cannot range freely over the travel surface. As for the radio-controlled, light-controlled or sound-controlled toys, they all require the user's active participation and skill to manipulate the various controls on the exterior remote-control unit in order to avoid obstacles which, when collided into, could otherwise cause damage to the remote-controlled toy.

SUMMARY OF THE INVENTION

1. Objects of the Invention

Accordingly, it is a general object of this invention to overcome the drawbacks of the prior art of mobile toys.

It is another object of this invention to provide a self-propellable, free-ranging, motor-driven, wheeled toy which automatically controls its own movements over a travel surface relative to obstacles in its path of advancement by either veering away from or advancing toward the obstacles.

It is a further object of this invention to provide such a toy which detects obstacles in its path and, in one operational mode, automatically turns away from the obstacles to avoid collisions therewith, thereby avoiding damage to or disablement of the toy due to such collisions.

It is still another object of this invention to provide such a toy which detects obstacles in its path and, in another mode of operation, automatically advances forwardly toward the obstacles and pursues them if they move away from the toy.

It is yet another object of this invention to eliminate the requirement to control the movement of a motor-driven mobile toy with the use of an exterior hand-held remote-control unit which requires a user's active participation and skill.

It is another object of this invention to eliminate the requirement to control the movement of a motor-driven mobile toy with the use of predetermined tracks which are fixed on the travel surface.

It is a still further object of this invention to provide such a toy which is durable in construction, inexpensive to manufacture, reliable in operation, and has rich entertainment value.

It is yet another object of this invention to provide a novel on-board control arrangement for and method of controlling the movement of a mobile toy which freely ranges over a travel surface.

2. Features of the Invention

In keeping with these objects, and others which will become apparent hereinafter, one feature of the invention resides, briefly stated, in an arrangement for controlling the movement of a self-propellable wheeled toy over a travel surface to be traversed, comprising drive means, e.g. a motor drive, operatively connected to a pair of drive wheels located at opposite sides of an upright axis which extends generally perpendicularly to the travel surface. In a preferred embodiment, the drive wheels are located at the rear of the toy, a pair of front wheels are located at the front of the toy, and the upright axis is a vertical axis located centrally of the toy between the rear drive wheels.

In a first operational state, the drive means are operative to propel the toy along a forward direction of advancement over the travel surface and, in a second operational state, to repetitively spin the toy about the upright axis.

The arrangement further comprises an on-board forwardly-facing transmitter, e.g. an infrared light source, mounted on the toy, and operative for forwardly transmitting a transmission signal, e.g. an infrared light beam, ahead of the toy; and on-board forwardly-facing receiver means, e.g. an infrared light detector, mounted on the toy, and operative for detecting and collecting that portion of the transmitted infrared light beam reflected off an obstacle located within a predetermined range ahead of the toy. The light detector preferably is a photosensor which generates an electrical control signal in response to such detection.

The arrangement still further comprises control means operatively connected to the receiver means and the drive means, and operative to change the operational states of the latter in response to such detection by the former. In other words, if the drive means is in its first operational state wherein the toy is advancing forwardly over the travel surface, then, in response to the detection of an obstacle in its path, the control means is operative to cause the toy to spin about its upright axis for a predetermined time and then, once the spinning is concluded, to advance forwardly in a direction away from the obstacle. Analogously, if the drive means is initially in its second operational state wherein the toy initially repetitively spins about the upright axis, then, in response to the detection of an obstacle in its path, the control means is operative to cause the toy to advance toward the obstacle and, if the latter moves, to pursue the same.

In an advantageous construction of this invention, the drive means includes a first electrical motor operatively connected to one of the drive wheels, and operative to rotate the one drive wheel in a predetermined direction in both operational states. In other words, no matter whether the drive means is in the first or the second operational state, the one drive wheel will always be rotated in the same predetermined direction, i.e. in the direction to forwardly propel the toy. As for the other drive wheel, the drive means includes a second electrical motor operatively connected thereto, and operative to rotate the other drive wheel in the same predetermined direction as the one drive wheel in the first operational state, and to rotate the other drive wheel in a countercurrent direction opposite to the predetermined direction of the one drive wheel in the second operational state. In this case, it is preferable if the second electrical motor is of the reversible type. Thus, in the first operational state, both the one and the other drive wheels are being rotated in the same direction to forwardly propel the toy and, in the second operational state, the one and the other drive wheels are rotated in reverse directions to spin the toy about the upright axis.

In another embodiment of this invention, rather than rotating the other drive wheel in a countercurrent direction, this invention proposes stopping the rotation of the other drive wheel in the second operational state. This will also cause the toy to spin about an upright axis; however, in this case, the upright axis is not centrally located between the rear drive wheels, but, instead, passes through the point of engagement between the stopped other drive wheel and the travel surface.

Another advantageous feature of this invention resides in a mode selector means, preferably constituted by an on-board manually-operable switch. This mode selector switch is operative for selecting between a first operational mode in which the first operational state is set initially and changed subsequently to the second operational state in response to said detection, and a second operational mode in which the second operational state is set initially and changed subsequently to the first operational state in response to said detection.

The first operational mode may be termed a so-called "detect and retreat" or "veer away" mode, wherein the toy is initially propelled in a forward direction, thereby causing the toy to advance. If, during this operational mode, an obstacle within a given predetermined range of the toy is detected by the infrared receiver, then an electrical control signal is generated by the receiver and processed by the control means, thereby resulting in the two drive wheels being caused to rotate in reverse directions and, as explained above, causing the toy to spin repeatedly in 360° revolutions about the upright axis for a predetermined time, e.g. about 3 seconds, whereupon the toy is caused to stop and then proceed forwardly along a different path angled from the original path of advancement; in other words, the toy has veered away from the confronting obstacle.

The second operational mode may be termed a so-called "detect and advance" or "attack" mode, wherein the toy is initially caused to spin repeatedly in 360° revolutions about its upright axis. If, during this operational mode, an obstacle within a given predetermined range of the toy is detected by the infrared receiver, then a different electrical control signal is generated and processed by the control means, thereby causing both drive wheels to rotate in the same forward direction and advance the toy toward the detected obstacle. Thus, the toy advances and "attacks" the confronting obstacle. Should the obstacle move away from the toy, then, of course, the toy will pursue the obstacle in this operational mode.

Still another advantageous feature of this invention resides in the method of controlling the movement of the aforementioned toy, said method comprising the following steps: propelling the toy in a first operational state along a forward direction of advancement over the travel surface; spinning the toy in a second operational state about an upright axis which extends generally perpendicularly to the travel surface; forwardly transmitting a transmission signal, e.g. an infrared light beam, ahead of the toy; detecting a returning portion of the infrared light beam reflected off an obstacle located within a predetermined range ahead of the toy; and changing the operational states of the toy in response to the previous detecting step.

Another advantageous feature of this invention is embodied in the self-propellable wheeled toy itself which, together with the aforementioned on-board control arrangement, includes a housing having a pair of drive wheels located at opposite sides of an upright axis which extends generally perpendicularly to the travel surface. The aforementioned drive means, transmitter means, receiver means and control means are all mounted on the housing and function as described above.

Hence, in accordance with this invention, no exterior remote-control units are required to be manipulated, and no fixed track need be laid out on the travel surface in advance. The self-propellable toy of this invention freely ranges over the travel surface and automatically, in the aforementioned first operational mode, avoids collisions with obstacles in its path. This latter feature avoids the problems described above in connection with bump and go toys which do not avoid such collisions.

In an advantageous construction, the toy is constructed as a robot, tank, jeep, truck or analogous vehicle, in a game simulation of war.

Still further, the use of a source of infrared light which, as opposed to white light, is not visible to the user, is of advantage when the war game simulation is conducted in dim ambient light or under fog-like conditions.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a top plan schematic view of a toy in accordance with this invention in a first mode of operation;

FIG. 2 is a top plan schematic view of the toy of FIG. 1 in a second mode of operation;

FIG. 3 is a schematic sectional plan view of the toy in accordance with this invention;

DETAILED DESCRIPTION OF THE PREFERRED EMBODIMENTS

Figure 6:
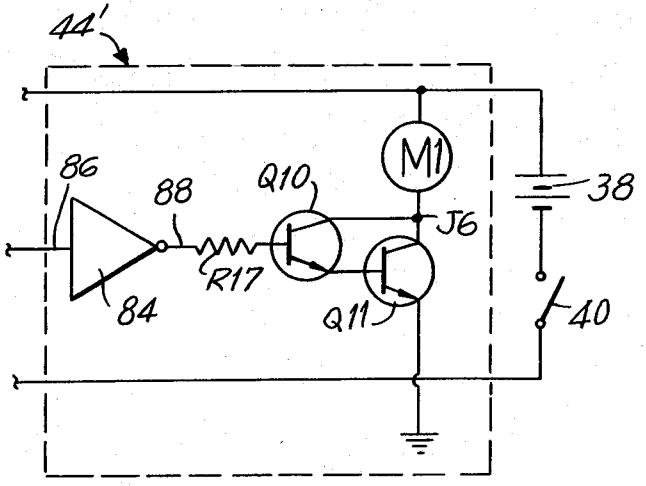
FIG. 6 is an electrical schematic diagram of another control subcircuit in accordance with this invention.

Referring now to the drawings and, more particularly, to FIGS. 1-3, reference numeral 10 generally identifies a self-propellable, motor-driven, free-ranging, wheeled, mobile action toy movable over a travel surface, e.g. the ground, a floor, a tabletop, or analogous generally horizontal supporting surface on which the toy travels. As best shown in FIG. 3, the toy 10 includes a housing 12, a pair of front wheels 14, 16 located at a front region of the housing and rotatably mounted for joint movement at opposite outer ends of a common front axle 18, and a pair of rear wheels 20, 22 located at a rear region of the housing, each rear wheel being independently mounted for rotation at the outer ends of a pair of independent rear axles 24, 26, respectively.

The inner ends of the rear axles 24, 26 are respectively connected to, and rotated by, a pair of electrical motors M1, M2 whose functions are described in detail below. Although the housing 12 is shown as being configured as a truck, it will be expressly understood that the invention is not to be so limited, and that other configurations for the housing are also within the scope of this invention. Thus, the housing can be shaped as any wheeled vehicle, e.g. a tank, jeep, car or the like; or can be shaped as any marine vehicle, e.g. a boat; or can be shaped as any aviation vehicle, e.g. an airplane; or can be shaped as any figurine, e.g. a humanoid, a robot, an animal, a cartoon character or the like. The housing can be shaped as any object whatsoever, provided that at least a pair of drive wheels are mounted for rotation on the same at opposite sides thereof.

As also shown in FIG. 3, an on-board forwardly-facing transmitter 30 is mounted on the toy adjacent an on-board forwardly-facing receiver 32. The transmitter 30 is a component part of a transmitter subcircuit 34 which is not shown in FIG. 3 for the sake of not overburdening the drawings, but which is shown in detail in FIG. 4. The receiver 32 is a component part of a receiver subcircuit 36 which is not shown in FIG. 3 for the sake of not overburdening the drawings, but which is shown in detail in FIG. 5. Also schematically shown in FIG. 3 are a self-contained electrical power source, e.g. a battery 38, mounted on the toy; a main power ON/OFF switch 40, preferably a manual switch mounted for sliding movement relative to the toy; and a mode selector switch 42, also preferably mounted for manual sliding movement relative to the toy, and operable as described below.

Figure 4:
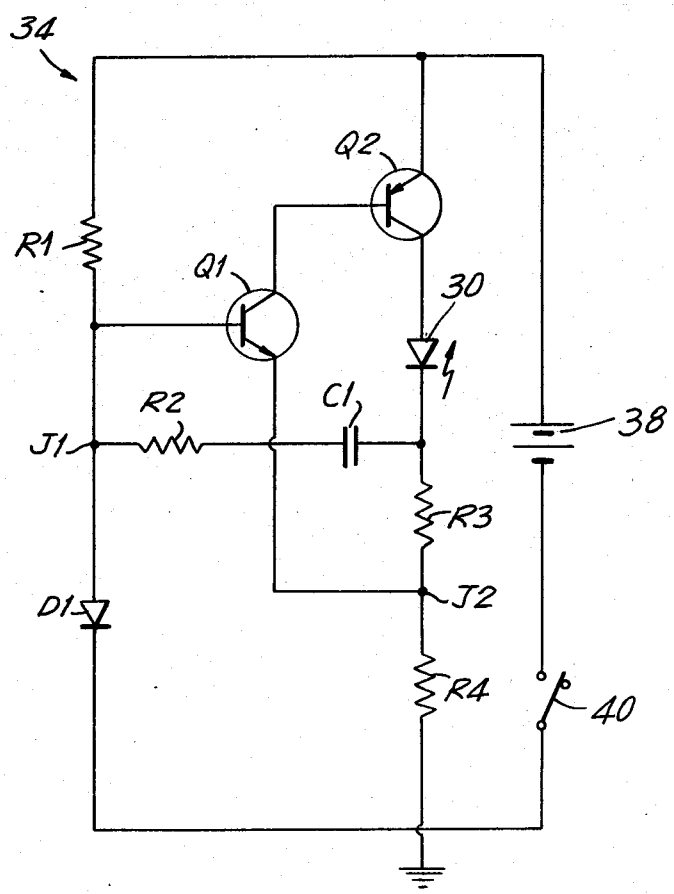
FIG. 4 is an electrical schematic diagram of a transmitter subcircuit on board the toy.

Turning now to the transmitter subcircuit 34 illustrated in FIG. 4, the transmitter 30 preferably is a light emitting diode operative for emitting light, preferably infrared light. Once the power switch 40 is closed, the voltage of battery 38 is applied across a resistor R1 and a rectifier diode D1. The junction J1 between the resistor R1 and the diode D1 is connected by means of a resistor R2 and a series connected capacitor C1 to the cathode of transmitting diode 30. The cathode of transmitting diode 30 also is connected through a pair of voltage divider resistors R3, R4 to ground. The junction J1 also is connected to the base of an NPN transistor Q1 whose emitter is connected to a junction J2 which is located between resistors R3 and R4. The collector of transistor Q1 is connected to the base of a PNP transistor Q2 whose emitter is connected to the positive side of the battery 38, and whose collector is connected to the anode of the transmitting diode 30. Once the power switch 40 is closed, the transistors Q1, Q2 both are biased ON, i.e. they are shortcircuited, thereby causing an electrical current to flow from the battery 38 through the transmitting diode 30, the latter then being operative to emit infrared light and to maintain this emission for as long as the power switch 40 is closed. Due to the forwardly-facing position of the transmitting diode 30 which, as shown in FIG. 1, is in a direction ahead of the toy, the transmitting diode 30 forwardly transmits a transmission signal or infrared light beam ahead of the toy. This infrared light beam is used, as described below, to search for obstacles in the forward path of advancement of the toy.

Figure 5:
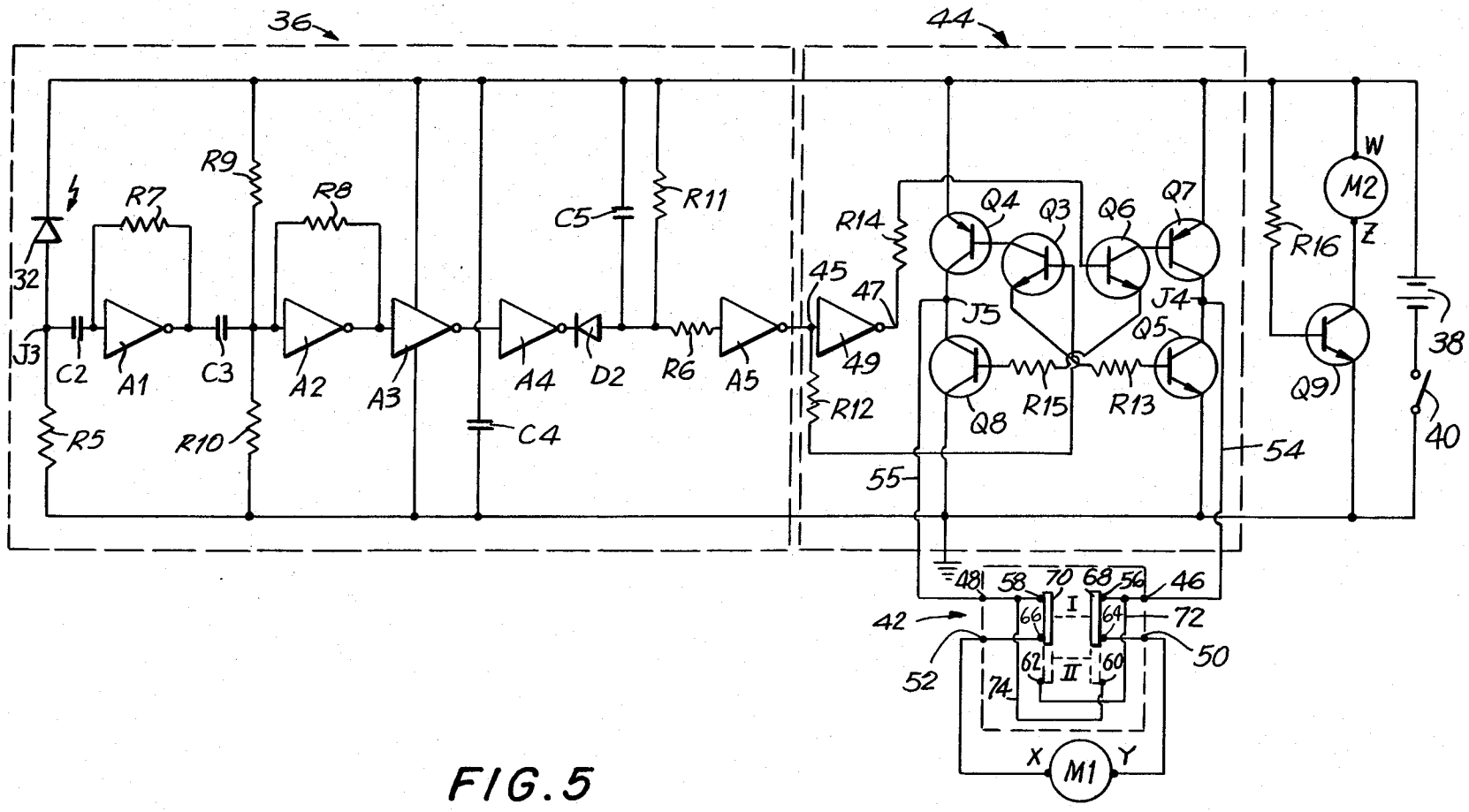
FIG. 5 is an electrical schematic diagram of a receiver and control subcircuit on board the toy.

Turning to the receiver subcircuit 36, illustrated in FIG. 5, the receiver 32 preferably is a photosensor or sensing diode operative for collecting and detecting light, specifically infrared light. If an obstacle, i.e. anything capable of reflecting infrared light, is located within a predetermined range ahead of the toy, and is illuminated by the infrared light beam, then the latter will be reflected off the obstacle, and at least a portion of the reflected light will be directed back toward the sensing diode 32. The reflected infrared light impinging upon the sensing diode 32 causes an electrical current to flow therethrough. The cathode of the sensing diode 32 is connected to the positive side of the battery 38, and the anode of the sensing diode 32 is connected through a resistor R5 to ground. A junction J3 located between the sensing diode 32 and the resistor R5 is connected to a series of inverting amplifiers A1, A2, A3, A4 and A5 whose collective function is to amplify an electrical signal present at junction J3, and to conduct any such amplified electrical signal to a control subcircuit 44.

More specifically, the input of amplifier A1 is connected through coupling capacitor C2 to junction J3. The output of amplifier A1 is coupled by capacitor C3 to the input of amplifier A2. The output of amplifier A2 is directly coupled to the input of amplifier A3 whose output, in turn, is directly coupled to the input of amplifier A4. The output of amplifier A4 is coupled through a diode D2 and a series connected resistor R6 to the input of amplifier A5. Resistors R7, R8 are respectively connected across the inputs and outputs of amplifiers A1, A2. A voltage dropping resistor R9 is connected between the positive side of the battery 38 and the input of amplifier A2. Another voltage dropping resistor R10 is connected between the input of amplifier A2 and ground. A capacitor C4 is connected across the battery 38 and the power switch 40. A parallel combination of a resistor R11 and a capacitor C5 is connected between the positive side of the battery 38 and the anode of the diode D2.

Turning to the control subcircuit 44, illustrated also in FIG. 5, any amplified signal existing at the output of amplifier A5 is conducted to an input terminal 45 of an inverting control amplifier 49 whose output terminal is identified by the reference numeral 47. The input terminal 45 is connected by a resistor R12 to the base of an NPN transistor Q3. The collector of transistor Q3 is connected to the base of a PNP transistor Q4. The emitter of transistor Q4 is connected to the positive side of the battery 38. The emitter of transistor Q3 is connected by means of a resistor R13 to the base of an NPN transistor Q5. The emitter of transistor Q5 is connected to ground.

The output terminal 47 of the control amplifier 49 is connected by means of a resistor R14 to the base of an NPN transistor Q6. The collector of transistor Q6 is connected to the base of a PNP transistor Q7. The emitter of transistor Q7 is connected to the positive side of the battery 38. The emitter of transistor Q6 is connected by means of a resistor R15 to the base of an NPN transistor Q8. The emitter of transistor Q8 is connected to ground. In addition, the collectors of transistors Q4 and Q8 are connected together, and also the collectors of transistors Q7 and Q5 are connected together.

The aforementioned mode selector switch 42, shown schematically in FIG. 3, is shown in more detail in FIG. 5. The selector switch 42 has a pair of input terminals 46, 48 and a pair of output terminals 50, 52. A first conductor 54 is connected between input terminal 46 and a junction J4 which is located between the collectors of transistors Q7, Q5. A second conductor 55 is connected between input terminal 48 and a junction J5 which is located between the collectors of transistors Q4, Q8. The selector switch 42 also has a first pair of interior switch contacts 56, 58, a second pair of interior switch contacts 60, 62, and a third pair of interior common contacts 64, 66. Interiorly of the switch, the switch contacts 56, 58 are connected to input terminals 46, 48, respectively; the common contacts 64, 66 are connected to output terminals 50, 52, respectively; and a pair of interior conductors 72, 74 are connected between switch contacts 56, 58 and switch contacts 62, 60, respectively.

The selector switch 42 further comprises a pair of manually movable joint armatures 68, 70 which preferably are slidable between a first position or mode selection I, shown in solid lines in FIG. 5, and a second position or mode selection II, shown in dashed lines in FIG. 5. The operation of the control subcircuit 44 in both operational modes of the selector switch 42 is described below.

It further will be noted from FIG. 5 that the motor M1, which preferably is a reversible electrical motor, has a pair of motor input terminals identified by reference characters X and Y, which respectively are connected to the output terminals 52, 50 of the selector switch 42. The other electrical motor M2 has one motor terminal W connected to the positive side of the battery 38, and its other motor input terminal Z connected to the collector of an NPN transistor Q9 whose emitter is connected to ground and whose base is connected through a resistor R16 to the positive side of the battery 38.

The operation of the toy is as follows: First, it should be noted that, regardless of the operational mode selected by the selector switch 42, and regardless of whether or not the transmitter subcircuit 34 is operational to emit an infrared light beam, and/or whether or not the receiver subcircuit 36 is operative to detect an obstacle in the advancement path of the toy, once the power switch 40 is closed, the transistor Q9 is biased via the resistor R16 to the ON state, and a current is caused to flow from the battery 38 through the motor M2 in the direction from motor input terminal W to motor input terminal Z. The motor M2, as schematically shown in FIG. 3, then is operative to rotate the rear drive wheel 22 in a predetermined direction and, specifically, in the forward direction of advancement of the toy. As for the other motor M1, the transmitter, receiver and control subcircuits are operative, depending upon the mode selected by the selector switch 42, to cause the motor M1 to either rotate the rear drive wheel 20 in the same predetermined direction as the drive wheel 22, i.e. forwardly, or to rotate the rear drive wheel 20 in the countercurrent direction, i.e. rearwardly, to that of the forward rotation of the wheel 22.

Returning to FIG. 4, by way of brief review, it will be remembered that once the power switch 40 is closed, the transistors Q1, Q2 both are biased ON and remain ON until the power switch is opened. Hence, an electrical current is caused to flow through the transmitting diode 30 which, when so energized, emits an infrared light beam forwardly of the toy. Should an obstacle be present ahead of the toy, some of the transmitted light beam will be reflected back toward the toy, and this reflected light will impinge upon and be detected by the sensing diode 32.

Returning to FIG. 5, it further will be recalled that when the sensing diode 32 is so energized, it converts the sensed light to an electrical signal which is thereupon amplified by amplifiers A1–A5. The so-amplified electrical signal then is conducted to the input terminal 45 of the control amplifier 49. The presence of an amplified signal at input terminal 45 of control amplifier 49 results in a high voltage being present at the input terminal 45, and a low voltage being present at the output terminal 47. Should no obstacle be present ahead of the toy, then no electrical signal is generated or amplified and, hence, this results in a low or no voltage being present at input terminal 45, and a high voltage being present at output terminal 47. These high and low voltages are used as control voltages to bias the respective transistors Q3–Q8 either ON or OFF, as described below.

Assuming that the power switch 40 has been closed, and that the mode selector switch 42 has been manually positioned by the user in the first operational mode I, and further assuming that initially there is no obstacle located ahead of the toy, then the sensing diode 32 does not sense any reflected light, in which event, the control voltage at input terminal 45 is low, and the control voltage at output terminal 47 is high. The low control voltage at input terminal 45 causes the transistor Q3 to be biased to the OFF state, i.e. cut off, which, in turn, also causes the transistors Q4 and Q5 likewise to be cut off. The high control voltage at output terminal 47 causes transistor Q6 to be biased to the ON state, i.e.

saturated, which, in turn, also causes the transistors Q7 and Q8 to be turned ON.

With the transistors so turned ON and OFF, an electrical current from the battery 38 will flow in the following closed loop path: Initially, the current will flow through the ON transistor Q7 to junction J4, and thereupon along conductor 54 to input terminal 46 of the selector switch 42. Thereupon, the current will flow across switch contacts 56, 64 through armature 68, and out through output terminal 50 to motor input terminal Y. Then, the current will flow through the motor M1 to the other motor terminal X to output terminal 52, whereupon, current will flow between switch contacts 66, 58 through armature 70 to the input terminal 48 of the selector switch 42. Then, the current will flow along conductor 55 to junction J5 and then to ground through the ON transistor Q8. As a result of this closed loop current flow, wherein, to repeat, the current flows through the reversible motor M1 in the direction from motor terminal Y to motor terminal X, the drive wheel 20 is rotated in the same direction as the drive wheel 22 and, hence, the toy is propelled forwardly. This operational state is shown schematically in FIG. 1 by the toy 10 shown in position P1 and by the forwardly directed arrow B.

If an obstacle, such as obstacle 80 in FIG. 1, is detected, then, as described above, a high control voltage is presented to input terminal 45 of control amplifier 49, and a low control voltage is presented at output terminal 47 thereof. The high control voltage at input terminal 45 causes transistor Q3 to be turned ON which, in turn, also causes transistors Q4 and Q5 to be turned ON. The low control voltage at output terminal 47 causes transistor Q6 to be cut off which, in turn, also causes transistors Q7 and Q8 to be cut off.

With the transistors so turned ON and OFF, an electrical current from the battery 38 will flow in the following closed loop path: Initially, the current will flow through the ON transistor Q4 to junction J5, and thereupon along conductor 55 to input terminal 48 of the selector switch 42. Then, the current will flow across switch contacts 58, 66 through armature 70, and out through output terminal 52 to motor input terminal X. Then, the current will flow through the motor M1 to the other motor terminal Y to output terminal 50, whereupon the current will flow between switch contacts 64, 56 through armature 68 to the input terminal 46 of the selector switch 42. Thereupon, the current will flow along conductor 54 to junction J4 and then to ground through the ON transistor Q5. As a result of this closed loop current flow, wherein, to repeat, the current flows through the reversible motor M1, in the direction from motor terminal X to motor terminal Y, the drive wheel 20 is rotated in the reverse direction as drive wheel 22 and, hence, the toy is caused to spin or turn about an upright axis 82 which extends generally perpendicularly to the travel surface and which is centrally located between the rear drive wheels 20, 22. This operational state is shown schematically in FIG. 1 by the toy 10 shown in position P2, and by the curved arrow E in which direction the toy moves to an offset position P3.

In the offset position P3, again no obstacle is detected ahead of the toy and, hence, the control circuit is operative, as described above, to forwardly advance the toy, this time in the direction of the forwardly directed arrow F. Thus, the toy has automatically veered away from the obstacle 80. This first operational mode I also is known as the "detect and retreat" mode since, once an obstacle has been detected, the toy turns away or retreats from the same.

Turning to the second operational mode II, wherein the armatures 68, 70 are moved to their respective dashedline positions in FIG. 5, the operation of the transmitter, receiver and control subcircuits is exactly as described above. For the sake of brevity, it will be noted that, when no obstacle is detected ahead of the toy, the transistors Q3, Q4 and Q5 will be cut off, and transistors Q6, Q7 and Q8 will be turned ON, and the electrical current from the battery 38 will flow through the ON transistor Q7 along the conductor 54 to the input terminal 46 of the selector switch 42, but, this time, rather than the current entering the motor at motor input terminal Y, the current is routed from the input terminal 46, along the internal conductor 72 to switch contact 62, across armature 70, and to switch contact 66, whereupon the current is conducted out through output terminal 52 and enters the motor at motor input terminal X. The current continues through the motor M1 and out through motor input terminal Y, and is routed between switch contacts 64, 60 through armature 68 and along internal conductor 74, to input terminal 48 of the selector switch 42. Finally, the current is conducted from input terminal 48 along conductor 55, and to ground through the ON transistor Q8.

In other words, when no obstacle is located in front of the toy in this second operational mode, the flow of current through the motor M1 is from its X terminal to its Y terminal. This current flow causes the drive wheel 20 to be rotated in the reverse direction to drive wheel 22 and, hence, the toy is caused to spin about the upright axis 82 in complete 360° revolutions. This operational state is shown schematically in FIG. 2 by the toy 10 in position P4, and by the circumferential arrow G.

Thereupon, if an obstacle, such as obstacle 80 in FIG. 2, is detected, then the transistors Q3, Q4 and Q5 will be turned ON, and the transistors Q6, Q7 and Q8 will be turned OFF and, in a manner completely analogous to that described above, current will flow through the motor M1 from its input terminal Y to its other input terminal X. This current flow causes the drive wheel 20 to be rotated in the same direction as the drive wheel 22 and, hence, the toy is propelled forwardly when an obstacle is detected in this operational mode. This operational state is shown schematically in FIG. 2 by the toy 10 in position P5, and by the forwardly directed arrow H.

This second operational mode also is known as the "detect and advance" mode since, once the toy detects an obstacle, it advances or attacks it. Should the obstacle 80 be movable and move away from the toy 10, then the toy will, in effect, lock onto the obstacle and pursue it.

In a variant of the control subcircuit 44 of this invention, attention now is directed to FIG. 6 wherein a control circuit 44' is illustrated. The control circuit 44' includes an inverting control amplifier 84 having an input terminal 86 and an output terminal 88, the latter being connected via a resistor R17 to the base of an NPN transistor Q10. The emitter of the transistor Q10 is connected to the base of another NPN transistor Q11. The collector of transistor Q10 is connected to the collector of transistor Q11. The emitter of transistor Q11 is grounded. The motor M1 is connected between the positive side of the battery 38 and the common junction J6 between the collectors of the transistors Q10, Q11.

As before, the motor M2 (not illustrated in FIG. 6) is energized whenever the power switch 40 is closed to drive the rear drive wheel 22 in the predetermined direction necessary to forwardly advance the toy. The control subcircuit 44' is operative to cause the motor M1 to either rotate the drive wheel 20 in the same forward direction as the drive wheel 22, or to slow or stop rotation of the drive wheel 20. Thus, when no obstacle is detected, a low control voltage is inputted to the input terminal 86 of the control amplifier 84, in which case, a high control voltage is present at the output terminal 88. This high control voltage biases the transistors Q10 and Q11 to the ON state. Thus, an electrical current will flow from the battery 38 through the motor M1 to ground, through the ON transistor Q11. The current flow through the motor M1 is such that the drive wheel 20 rotates in the same forward direction as the drive wheel 22.

Should an obstacle be detected, then a high control voltage is located at the input terminal 86, and a low control voltage is present at the output terminal 88 of the control amplifier 84. This low control voltage turns the transistors Q10 and Q11 OFF, thereby causing no electrical current to flow through the motor M1 and, in effect, the rear wheel 20 is stopped. The stopping of wheel 20 and the forward rotation of the other drive wheel 22 causes the toy to spin about an upright axis which extends through the point of contact of the rear wheel 20 with the travel surface in a direction perpendicular to the same. If, during the course of this turning movement, no obstacle is again detected, then the motor M1 will again be energized to rotate the drive wheel 20 in the same direction as the drive wheel 22 such that the toy once again can be propelled forwardly toward the detected obstacle.

It will be understood that each of the elements described above, or two or more together, also may find a useful application in other types of constructions differing from the types described above.

For example, rather than using an infrared light transmitter and receiver, the toy also can be made operative with an acoustic transmitter and receiver. In an improved modification of this invention, the toy, in it spinning state, need not be left to spin endlessly, but can perform a predetermined number of revolutions and then be made to deliberately stop and proceed forwardly in a direction which is angled from an initial forward advancement path.

While the invention has been illustrated and described as embodied in a self-propellable toy and arrangement for and method of controlling the movement thereof, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims; I claim:

1. An arrangement for controlling the movement of a self-propellable, wheeled toy over a travel surface to be traversed, comprising:

(a) drive means operatively connected to a pair of drive wheels located at opposite sides of an upright axis which extends generally perpendicularly to the travel surface and operative, in a first operational state, to propel the toy along a forward direction of advancement over the travel surface and, in a second operational state, to spin the toy about the upright axis;.

(b) on-board, forwardly-facing transmitter means on the toy, and operative for forwardly transmitting a transmission signal ahead of the toy;

(c) on-board, forwardly-facing receiver means on the toy, and operative for detecting a returning portion of the transmission signal reflected off an obstacle located within a predetermined range ahead of the toy;

(d) control means operatively connected to the receiver means and the drive means, and operative to change the operational states of the latter in response to such detection by the former; and (e) mode selector means operatively connected to the control means, and operative for selecting between a first operational mode in which the first operational state is set initially and changed subsequently to the second operational state in response to said detection, and a second operational mode in which the second operational state is set initially and changed subsequently to the first operational state in response to said detection.

2. The arrangement as recited in claim 1, wherein the transmitter means includes an infrared light source operative for forwardly emitting an infrared light beam ahead of the toy; and wherein the receiver means includes an infrared light detector operative for detecting that portion of the infrared light beam reflected off the obstacle and returned to the detector, and for generating an electrical control signal in response to such detection.

3. The arrangement as recited in claim 1, wherein the drive means includes a first electrical motor operatively connected to one of the drive wheels, and operative to rotate the one drive wheel in a predetermined direction in both operational states.

4. The arrangement as recited in claim 3, wherein the drive means includes a second electrical motor operatively connected to the other of the drive wheels, and operative to rotate the other drive wheel in the same predetermined direction as the one drive wheel in the first operational state, and to rotate the other drive wheel in a countercurrent direction opposite to the predetermined direction of the one drive wheel in the second operational state.

5. The arrangement as recited in claim 3, wherein the drive means includes a second electrical motor operatively connected to the other of the drive wheels, and operative to rotate the other drive wheel in the same predetermined direction as the one drive wheel in the first operational state, and to stop rotation of the other drive wheel in the second operational state.

6. The arrangement as recited in claim 4, wherein the second electrical motor is of the reversible type, and wherein the control means includes an electrical power source, and means for directing an electrical current from the power source to flow in one direction through the reversible motor in the first operational state, and to flow in a reverse direction through the reversible motor in the second operational state.

7. An arrangement for controlling the movement of a self-propellable, wheeled toy over a travel surface to be traversed, comprising:

(a) drive means operatively connected to a pair of drive wheels located at opposite sides of an upright axis which extends generally perpendicularly to the travel surface and operative, in a first operational state, to propel the toy along a forward direction of advancement over the travel surface and, in a second operational state, to spin the toy about the upright axis, said drive means including a first electrical motor operatively connected to one of the drive wheels, and operative to rotate the one drive wheel in a predetermined direction in both operational states, said drive means also including a second electrical motor operatively connected to the other of the drive wheels, and operative to rotate the other drive wheel in the same predetermined direction as the one drive wheel in the first operational state, and to control the movement of the other drive wheel in the second operational state;

(b) on-board, forwardly-facing, infrared light transmitter means on the toy, and operative for forwardly transmitting an infrared light beam ahead of the toy;

(c) on-board, forwardly-facing, infrared light receiver means on the toy, and operative for detecting a returning portion of the infrared light beam reflected off an obstacle located within a predetermined range ahead of the toy;

(d) control means operatively connected to the receiver means and the drive means, and operative to change the operational states of the latter in response to such detection by the former; and (e) mode selection means operatively connected to the control means, and operative for selecting between a first operational mode in which the first operational state is set initially and changed subsequently to the second operational state in response to said detection, and a second operational mode in which the second operational state is set initially and changed subsequently to the first operational state in response to said detection.

8. A self-propellable, wheeled toy movable over a travel surface to be traversed, comprising:

(a) a housing having a pair of drive wheels located at opposite sides of an upright axis which extends generally perpendicularly to the travel surface;

(b) drive means operatively connected to the drive wheels and operative, in a first operational state, to propel the toy along a forward direction of advancement over the travel surface and, in a second operational state, to spin the toy about the upright axis;

(c) on-board, forwardly-facing transmitter means on the toy, and operative for forwardly transmitting a transmission signal ahead of the toy;

(d) on-board, forwardly-facing receiver means on the toy, and operative for detecting a returning portion of the transmission signal reflected off an obstacle located within a predetermined range ahead of the toy;

(e) control means operatively connected to the receiver means and the drive means, and operative to change the operational states of the latter in response to such detection by the former; and (f) mode selector means operatively connected to the control means, and operative for selecting between a first operational mode in which the first operational state is set initially and changed subsequently to the second operational state in response to said detection, and a second operational mode in which the second operational state is set initially and changed subsequently to the first operational state in response to said detection.

9. The toy as recited in claim 8, wherein the transmitter means includes an infrared light source operative for forwardly emitting an infrared light beam ahead of the toy; and wherein the receiver means includes an infrared light detector operative for detecting that portion of the infrared light beam reflected off the obstacle and returned to the detector, and for generating an electrical control signal in response to such detection.

10. The toy as recited in claim 8, wherein the drive means includes a first electrical motor operatively connected to one of the drive wheels, and operative to rotate the one drive wheel in a predetermined direction in both operational states.

11. The toy as recited in claim 10, wherein the drive means includes a second electrical motor operatively connected to the other of the drive wheels, and operative to rotate the other drive wheel in the same predetermined direction as the one drive wheel in the first operational state, and to rotate the other drive wheel in a countercurrent direction opposite to the predetermined direction of the one drive wheel in the second operational state.

12. The toy as recited in claim 10, wherein the drive means includes a second electrical motor operatively connected to the other of the drive wheels, and operative to rotate the other drive wheel in the same predetermined direction as the one drive wheel in the first operational state, and to stop rotation of the other drive wheel in the second operational state.

13. The toy as recited in claim 11, wherein the second electrical motor is of the reversible type, and wherein the control means includes an electrical power source, and means for directing an electrical current from the power source to flow in one direction through the reversible motor in the first operational state, and to flow in a reverse direction through the reversible motor in the second operational state.

14. A method of controlling the movement of a self-propellable, wheeled toy over a travel surface to be traversed, comprising the steps of providing means for:

(a) propelling the toy, in a first operational state, along a forward direction of advancement over the travel surface;

(b) spinning the toy, in a second operational state, about an upright axis which extends generally perpendicularly to the travel surface;

(c) forwardly transmitting a transmission signal ahead of the toy;

(d) detecting a returning portion of the transmission signal reflected off an obstacle located within a predetermined range ahead of the toy;

(e) changing the operational states of the toy in response to such detection; and (f) selecting between a first operational mode in which the first operational state is set initially and changed subsequently to the second operational state in response to said detection, and a second operational mode in which the second operational state is set initially and changed subsequently to the first operational state in response to said detection.

15. The method as recited in claim 14, wherein the transmitting step is performed by forwardly emitting an infrared light beam, and wherein the detecting step is performed by detecting that portion of the infrared light beam reflected off the obstacle and returned to the detector.

* * * * *